United States Patent [19]

Dahl

[11] Patent Number: 4,622,898

[45] Date of Patent: Nov. 18, 1986

[54] SPIN ACTIVATED MECHANISM

[75] Inventor: Randy L. Dahl, Scottsdale, Ariz.

[73] Assignee: Motorola, Inc, Schaumburg, Ill.

[21] Appl. No.: 718,322

[22] Filed: Apr. 1, 1985

[51] Int. Cl.[4] ..... F42C 15/22

[52] U.S. Cl. ..... 102/237; 102/240; 102/241; 102/243; 102/262

[58] Field of Search ..... 102/240, 262, 237, 239, 102/241, 243, 245, 221, 222

[56] References Cited

U.S. PATENT DOCUMENTS

| | | | |
|---|---|---|---|
| 2,924,177 | 2/1960 | Crozier | 102/243 |
| 2,983,800 | 5/1961 | Rabinow | 102/262 X |
| 3,329,090 | 7/1967 | Rhoads | 102/241 |
| 3,750,589 | 8/1973 | Egli et al. | 102/237 |
| 4,167,905 | 9/1979 | Kosonucky et al. | 102/241 X |
| 4,223,608 | 9/1980 | Backstein et al. | 102/237 X |
| 4,242,963 | 1/1981 | Ziemba | 102/240 X |
| 4,378,740 | 4/1983 | Schneider | 102/262 X |
| 4,432,283 | 2/1984 | Duffner | 102/240 X |

*Primary Examiner*—David H. Brown

*Attorney, Agent, or Firm*—Raymond J. Warren

[57] ABSTRACT

The mechanism consists of a one coil spring disposed a spaced distance about the inner circumference of a cylindrical housing; and a lever pivotally attached to said housing. When the device is subjected to centrifugal forces the coil is forced outward towards the inner wall of the cylindrical housing causing the two ends of the coil to be separated. Once separated, the lever may pivot causing one end to contact the inner wall of the cylindrical housing and the second end to pivot away from the inner wall of the cylindrical housing and contact a activating device.

5 Claims, 3 Drawing Figures

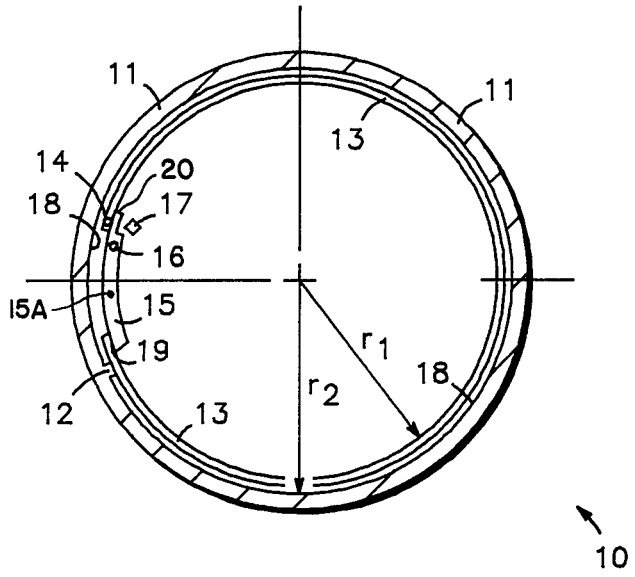
FIG. 1
FIG. 2
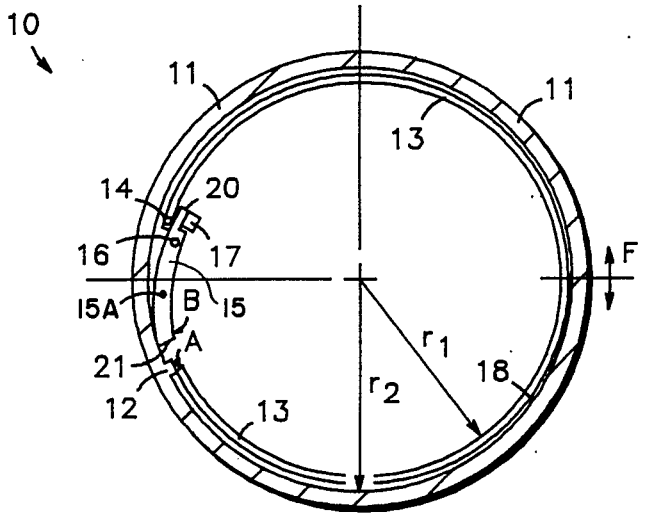

SPIN ACTIVATED MECHANISM

BACKGROUND OF THE INVENTION

This invention relates, in general, to spin activated mechanisms and, more particularly, to spin activated mechanisms used as safe and arming devices, or the like, for munitions.

Numerous apparatus and methods are known in the art for safe and arming munitions. However, in general these numerous apparatus and methods are contained in the center of the munition. In some applications, it is not practical to have a safe and arming devices in the center of the munition. This requires other devices and areas to be utilized.

In addition, many safe and arming devices are designed so as to be under stress while at rest. This stress is then usually released at an appropriate time to arm the munition. This causes a problem since having a device under stress for a long shelf life causes problems in the design of the device due to aging. These problems entail such things as a spring loosing its resilience or other mechanical components suffering similar decay due to prolonged stress.

SUMMARY OF THE INVENTION

Accordingly, it is an object of the present invention to provide a spin activated mechanism and method that will overcome the deficiencies of the prior art.

A further object of the present invention is to provide a spin activated mechanism and method that will be disposed about the inner circumference of a munition.

Still another object of the present invention is to provide a spin activated mechanism and method of safe and arming a munition that is not under stress when not in use.

Another object of the present invention is to provide a spin activated mechanism and method that can be constructed to operate over a wide range of rotational forces.

The above and other objects and advantages of the present invention are provided by a spin activated mechanism and method of providing a mechanical spring about the inner circumference of a munitions shell.

A particular embodiment of the present invention consists of a spin activated mechanism comprising: a cylindrical housing having an inner circumference being defined by an inner wall, said inner wall having a stub protruding therefrom and extending radially inward from said inner wall; trigger means for activating a device, said activating means having a first end and a second end, said first end being pivotally coupled to said device such that when said device is subjected to centrifugal forces said second end may pivot causing it to contact said inner wall of said cylindrical housing; and spring means for restraining said activating means, said spring means having an inner side, an outer side, and a coil, said coil having a first end and a second end, said coil being juxtaposed to said inner wall of said cylindrical housing, said first end being secured to said device, said second end contacting said stub of said cylindrical housing on said outer side of said coil and said inner side of said coil contacting said activating means such that said second end of said activating means is prevented from contacting said inner wall of said cylindrical housing, said spring means being disposed such that as said spin activated mechanism is subjected to centrifugal forces said coil is forced against said inner wall of said cylinder causing said second end of said coil to be separated from said second end of said activating means allowing said activating means to pivot causing said second end of said activating means to contact said inner wall.

BRIEF DESCRIPTION OF THE DRAWINGS

FIG. 1 is an illustration of a spin activated mechanism at rest embodying the present invention;

FIG. 2 is an illustration of the spin activated mechanism of FIG. 1 when subjected to centrifugal forces.

DETAILED DESCRIPTION OF THE DRAWINGS

Figure 3:
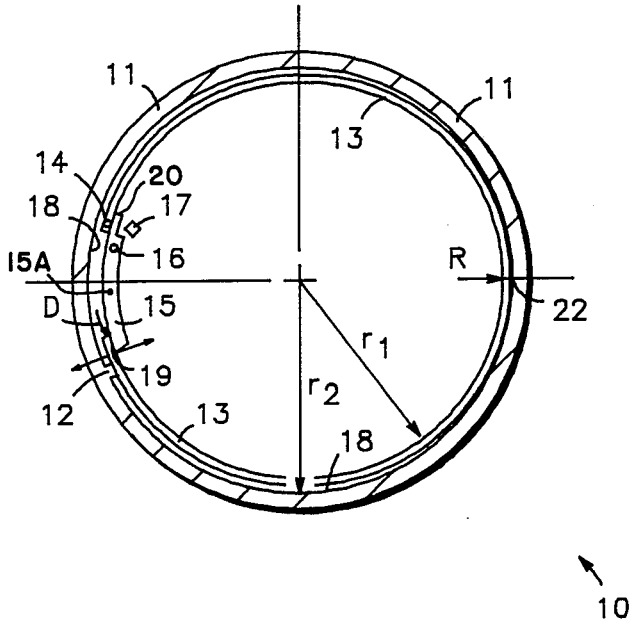
FIG. 3 is an illustration of the spin activated mechanism of FIG. 1 when subjected to radial forces.

Referring now to the diagram of FIG. 1, a spin activated mechanism, generally designated 10, is illustrated. Spin activated mechanism 10 consists of a cylindrical device housing 11 having an inner wall 18 and a stub 12 extending radially inward therefrom. Circularly shaped spring 13, having an outer radius slightly less than the inner radius of wall 18, is positioned generally coaxially within device housing 11 and secured at one end by a pin 14. An elongated lever 15 is positioned in sliding engagement with spring 13 and is pivotally secured at one end by a pin 16 for radial movement. Pin 16 is positioned between the center of gravity 15A of lever 15 and a second end 20. An activating center 17 is positioned adjacent to lever 15 but spaced radially inward therefrom.

When spin activated mechanism 10 is at rest, as in FIG. 1, there is no stress on spring 13 or lever 15. By making spring 13 a predetermined radius, $r_1$, less than the radius, $r_2$, of inner wall 18; and by having pin 14 and stub 12 properly spaced from inner wall 18, spring 13 will maintain a relatively constant distance from inner wall 18.

Lever 15 and spring 13 are designed to be in contact along a line 19. This prevents lever 15 from being accidentally pivoted into contact with activating center 17.

Referring now to FIG. 2, spin activated mechanism 10 is illustrated when subjected to centrifugal forces, F. The centrifugal force, F, exerted on mechanism 10 may be in either direction, as indicated. Force F causes spring 13 to expand radially outward against wall 18. Since one end of spring 13 is fixed by pin 14 the other end moves circumferentially along a line indicated by arrow A.

Once the end of spring 13 moves past lever 15, centrifugal force F causes an end 21 of lever 15 to move toward inner wall 18 in the direction indicated by arrow B. The movement of lever 15 causes the second end 20 of lever 15 to come into contact with activating center 17. Activating center 17 may consist of a secondary safety device such as a trigger or stab actuator which activates a small switch on a battery. The battery could be used to activate various electrical components such as communications, detonation or similar articles.

Spring 13 may be designed to provide any desired strength so that a predetermined amount of centrifugal force would be required to be exerted on mechanism 10 before spring 13 would break contact with lever 15.

Referring now to FIG. 3, spin activated mechanism 10 is illustrated being subjected to a radial force, R, which may occur when the device is dropped. As shown spring 13, reacting to force R, has contacted inner wall 18 at a point 22. This would attempt to move the free end of spring 13 in the direction of force R. Since the free end of spring 13 is prevented by lever 15 from moving in the direction of R the free end will alternatively slide along line 19 as indicated by arrow D. As is illustrated, however, spring 13 does not move far enough to break contact with lever 15. This insures that mechanism 10 will not accidentally be set off.

As mechanism 10 is illustrated, FIG. 1, the contacting ends of spring 13 and lever 15 are angled. This is so that when spring 13 and lever 15 break contact, lever 15 will not be stopped by spring 13 pushing back against it. If spring 13 does release and press back against the end of lever 15 then the angle ends will allow lever 15 to continue pivoting.

This device could also be used to mechanically move a detonator in line with a lead charge causing the munition to detonate. This may require additional devices that are well known in the art.

Thus, it is apparent that there has been provided in accordance with the invention, a device and method that fully satisfies the objects, aims and advantages set forth above.

While spring 13 has been illustrated as a circular spring having a circumferential length only slightly less than the inner circumference of cylindrical housing 11, it will be understood by those skilled in the art that the spring might contain more than one coil or it might be equal in length to only a fraction of the inner circumference of cylindrical housing 11. The only limiting factor is to provide sufficient movement in response to centrifugal force to release an activating mechanism, such as lever 15.

It has been shown that the present spin activated mechanism provides an apparatus and method that is not subject to forces when at rest; that will not accidentally be set off due to mishandling; and that leaves the interior of the device to be utilized for other apparatus.

While the invention has been described in conjunction with specific embodiments thereof, it is evident that many alterations, modifications, and variations will be apparent to those skilled in the art in light of the foregoing description. Accordingly, it is intended to embrace all such alterations, modifications and variations in the appended claim.

I claim:

1. A spin activated mechanism for activating a device comprising:

a cylindrical housing having an inner circumference being defined by an inner wall, said inner wall having a stub protruding radially inwardly therefrom;

activating means for activating said device, said activating means having a first end and a second end, said first end being pivotally mounted relative to said cylindrical housing such that when said device is subjected to centrifugal forces said second end may pivot causing it to contact said inner wall of said cylindrical housing; and a coil spring for restraining said activating means, said spring having an inner side, an outer side, a first end and a second end, said coil spring being mounted coaxially with and in juxtaposition to said inner wall of said cylindrical housing, said first end of said coil spring being secured relative to said cylindrical housing, said second end of said coil spring contacting said stub of said cylindrical housing on said outer side of said coil and said inner side of said coil contacting said activating means such that said second end of said activating means is prevented from contacting said inner wall of said cylindrical housing, said coil spring of predetermined length relative to said inner wall of said cylindrical housing and said second end of said activating means being disposed such that as the spin activated mechanism is subjected to centrifugal forces said coil spring is forced against said inner wall of said cylindrical housing causing the distance between said secured first end of said coil spring and said second end of said coil spring to increase a predetermined distance, allowing said activating means of predetermined length relative to said second end of said coil spring and said inner wall of said cylindrical housing to pivot causing said second end of said activating means to contact said inner wall.

2. The spin activated mechanism of claim 1 wherein said activating means comprises a lever having the first end, the second end, and a center of gravity, said lever being pivotally coupled to said device between said center of gravity and said first end such that when said device is subjected to centrifugal forces said second end of said lever will pivot causing it to contact said inner wall of said cylindrical housing, and said first end will pivot away from said inner wall of said cylindrical housing contacting a firing mechanism.

3. The spin activated mechanism of claim 1 wherein said coil spring comprises a spring having a single coil.

4. A spin activated mechanism comprising:

a cylindrical housing having an inner circumference being defined by an inner wall, said inner wall having a stub protruding radially inwardly therefrom;

a lever having a first end, a second end, and a center of gravity, said lever being pivotally coupled to said device between said center of gravity and said first end such that when said device is subjected to centrifugal forces said second end may pivot causing it to contact said inner wall of said cylindrical housing and causing said first end to pivot contacting an activating device; and a spring having an inner side, an outer side, and a coil, said coil having a first end and a second end, said coil being juxtaposed to said inner wall of said cylindrical housing, said first end being secured to said device, said second end contacting said stub of said cylindrical housing on said outer side of said coil and said inner side of said coil contacting said lever such that said second end of said lever is prevented from contacting said inner wall of said cylindrical housing, said spring being disposed such that as said spin activated mechanism is subjected to centrifugal forces said coil of predetermined length relative to said inner wall of said cylindrical housing and said second end of said activating means is forced against said inner wall of said cylindrical housing causing the distance between said secured first end of said coil and said second end of said coil spring to increase a predetermined distance allowing said lever of predetermined length relative to said second end of said coil spring and said inner wall of said cylindrical housing to pivot causing said second end of said lever to contact said inner wall.

5. A method of safe and arming a device comprising the steps of:

providing a cylindrical housing having an inner circumference being defined by an inner wall, said inner wall having a stub protruding radially inward therefrom;

providing a lever having a first end, a second end and a center of gravity, said lever being pivotally coupled to said device between said first end and said center of gravity;

providing a spring having an inner side, an outer side, and a coil, said coil having a first end and a second end, said coil being juxtaposed to said inner wall of said cylindrical housing, said first end being secured to said device, said second end contacting said stub of said cylindrical housing on said outer side of said coil and said inner side of said coil contacting said lever;

subjecting said device to centrifugal forces;

causing said spring to be forced radially against said inner wall of said cylindrical housing;

causing said second end of said coil to move circumferentially away from said first end of said coil;

releasing said lever; and forcing said second end of said lever to contact said inner wall of said cylindrical housing and forcing said second end of said lever to contact an activating device.

* * * * *